US005505445A

United States Patent [19]

Treadwell et al.

[11] Patent Number: 5,505,445

[45] Date of Patent: Apr. 9, 1996

[54] FOOTBALL KICKING TEE

[76] Inventors: David Treadwell, 5860 S. Forest St., Greenwood Village, Colo. 80121; Jack K. Lanier, 5153 Sanibel Dr., Jacksonville, Fla. 32210; Richard Treadwell, 13425 Mandarin Rd., Jacksonville, Fla. 32223

[21] Appl. No.: 427,092

[22] Filed: Apr. 21, 1995

[51] Int. Cl.[6] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| 235,462 | 6/1975 | Pennington | 273/55 B |
| 3,105,686 | 10/1963 | Elsea | 273/55 B |
| 3,439,916 | 4/1969 | Kapp | 273/55 B |
| 3,462,145 | 8/1969 | Shirley et al. | 273/55 B |
| 3,516,667 | 6/1970 | Williams | 273/55 B |
| 3,762,706 | 10/1973 | Cavett | 273/55 B |
| 3,879,948 | 8/1975 | Gerela | 273/55 B |
| 3,897,948 | 8/1975 | Gerela | 273/55 B |
| 3,917,278 | 11/1975 | Steinman, Jr. | 273/55 B |
| 4,203,242 | 5/1980 | Griffin | 273/55 B |
| 4,477,077 | 10/1984 | Ferrebee | 273/55 B |
| 4,546,974 | 10/1985 | Brown | 273/55 B |
| 4,632,395 | 12/1986 | Freebee | 273/55 B |
| 4,634,122 | 1/1987 | Kline | 273/55 B |
| 4,807,880 | 2/1989 | Deal | 273/55 B |
| 4,946,165 | 8/1990 | Rambacher | 273/55 B |
| 5,303,890 | 4/1994 | Carruth . | |

*Primary Examiner*—Theatrice Brown
*Attorney, Agent, or Firm*—Shlesinger Arkwright Garvey

[57] ABSTRACT

A kicking tee for holding a football in an upright position for kicking, comprises first, second and third legs having respective first and second end portions. The first and second legs first end portions are secured together to form an inverted "V" in a substantially vertical plane with the first and second legs second end portions engaging the ground. The third leg first end portion is secured to the first and second legs first end portions such that the third leg is disposed substantially horizontally when the third leg second end portion engages the tip of the football.

20 Claims, 1 Drawing Sheet

FOOTBALL KICKING TEE

FIELD OF THE INVENTION

The present invention generally relates to a football kicking tee and more particularly to a football holder for place kicking without the assistance of another person.

BACKGROUND OF THE INVENTION

The place kicker in a football game could make or break a game. There had been several occasions in the past when the outcome of a game depended on a kicker making a field goal. Thus, accuracy in place kicking is an essential component in a team's eventual success in football.

Typically, in actual play, one player assists the kicker in supporting the ball in an upright position, pressing the hall's upper tip downwardly with his index finger, with the other tip resting on the playing surface or a kicking plate commonly called a tee.

Proficiency in place-kicking is attained through hours of practice throughout the year, during and out of season. The ideal practice condition is to have another person hold the ball for the place kicker. However, it is uneconomical to dedicate a player simply to hold the ball for the place kicker. Further, if the kicker were just to practice by himself, without anybody around, a holder would not be available.

There is therefore a need for a football kicking tee that can be used by a place kicker during his hours of practice without employing another person to hold the ball while at the same time simulating a player holder for ideal practice conditions.

OBJECTS AND SUMMARY OF THE INVENTION

It is an object of the present invention to provide a football kicking tee that takes the place of a player holder during practice of the place kicker.

It is another object of the present invention to provide a football kicking tee that holds the ball in an upright position by pressing the ball's upper tip while the other tip is supported by the ground, thereby simulating a place holder.

It is still another object of the present invention to provide a football kicking tee that is compact for carrying around and for storage.

It is another object of the present invention to provide a football kicking tee that is relatively simple to set up, operate and adjust.

It is still another object of the present invention to provide a football kicking tee that is relatively inexpensive to manufacture.

It is yet another object of the present invention to provide a football kicking tee that is adjustable to accommodate different sizes of footballs.

These and other objects of the present invention will become apparent from the following detailed description. dr

DETAILED DESCRIPTION OF THE INVENTION

Figure 1:
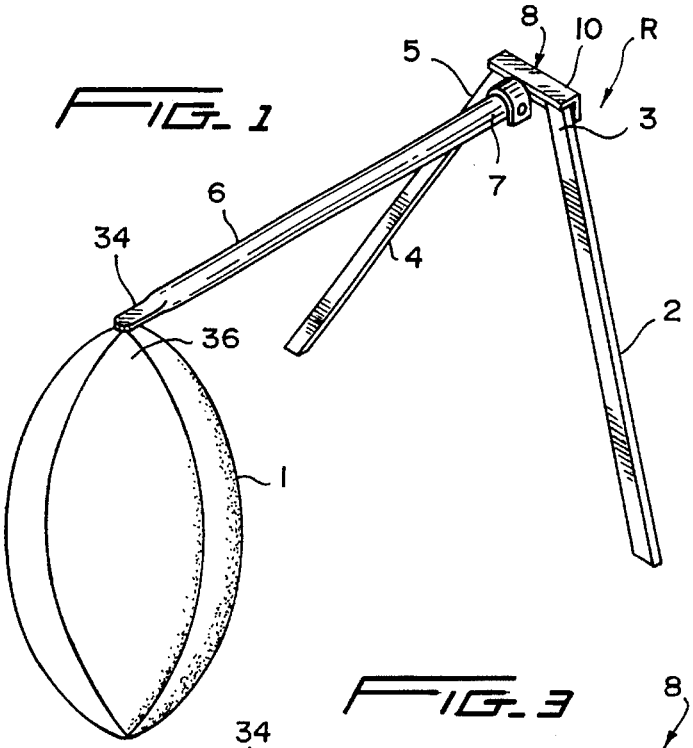
FIG. 1 is a perspective view of a football kicking tee in accordance with the present invention, shown supporting a football for kicking.

A football kicking tee R made in accordance with the present invention is disclosed in FIG. 1. The kicking tee R is used to hold a football 1 in an upright position for kicking by a place-kicker. The tee R comprises three pivotable legs 2, 4 and 6, as best shown in FIG. 1. The legs 2, 4, and 6 have one of their end portions 3, 5 and 7 pivotably secured to a pivot structure 8. The legs 2, 4 and 6 are preferably equal in lengths.

Figure 2:
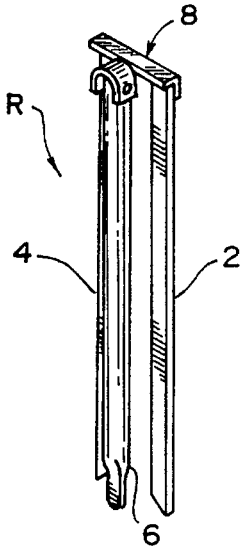
FIG. 2 is the kicking tee of FIG. 1, shown in a folded or collapsed form for stowage.
Figure 3:
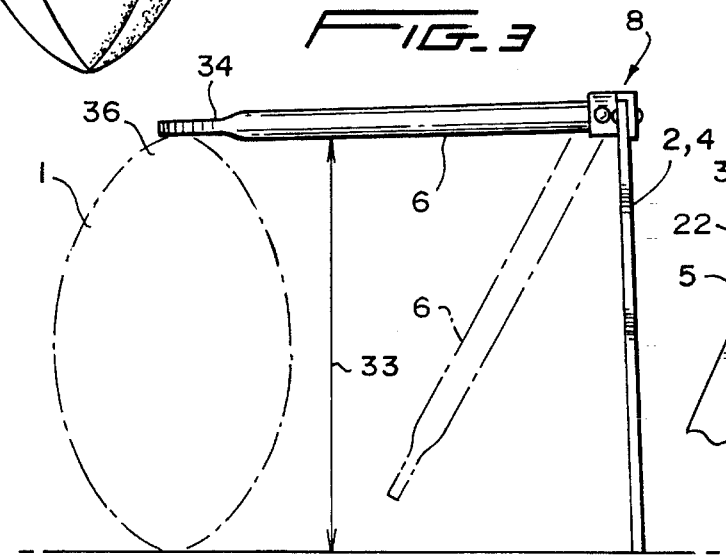
FIG. 3 is a side elevational view of FIG. 1, showing the football engaging arm in phantom lines being extended or folded.

The legs 2 and 4 are pivotable from their stored or collapsed positions where they are substantially parallel to each other to their deployed positions where they form an inverted "V" as best shown in FIGS. 1 and 2. Similarly, the leg 6 is pivotable from its deployed position where it is substantially parallel to the ground to its stored or collapsed position where it is substantially parallel to the legs 2 and 4 in their stored positions, as best shown in FIGS. 2 and 3.

Figure 4:
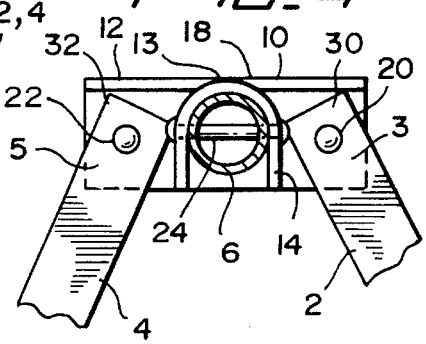
FIG. 4 is an enlarged fragmentary view of the pivot structure used in the kicking tee of FIG. 1.
Figure 5:
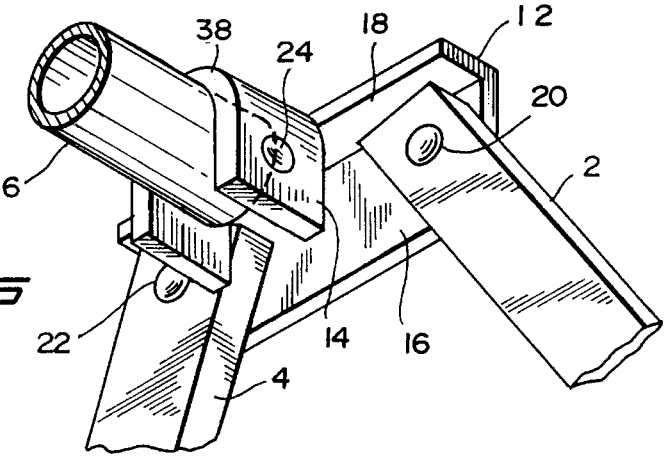
FIG. 5 is an enlarged fragmentary bottom perspective view of the pivot structure of the kicking tee of FIG. 1.

The pivot structure 8 includes an angle bracket 12 which is substantially "L"-shaped in cross-section and a "U"-shaped bracket 14 integrally connected to bracket 12 at 13, as best shown in FIGS. 4 and 5. The angle bracket 12 has transverse sides 16 and 18.

Pivots 20 and 22 secure the end portions 3 and 5 of the legs 2 and 4, respectively, to the side 16. The bracket 14 includes a pivot 24 that secures the end portion 7 of the leg 6 to the structure 8, as best shown in FIG. 5. The pivots 20, 22 and 24 are disposed such that the legs 2 and 4 move along substantially the same plane while the leg 6 moves along a plane substantially transverse to the plane of the legs 2 and 4.

The bracket 14 is advantageously formed from the side 18 of the angle portion 12.

The end portions 3 and 5 include corners 30 and 32 that engage the side 18 when the legs 2 and 4 are pivoted apart to their operative or deployed position, thereby providing a limit as to the maximum distance the legs 2 and 4 can be spread apart, thereby affecting a vertical height 33 the leg 6 in the horizontal position makes with the ground, as best shown in FIG. 3. The corners 30 and 32 advantageously provide deployment stops for quick setup of the kicking tee R.

It will be understood by a person of ordinary skill in the art that the height 33 may be varied by how much the legs 2 and 4 are spread apart and also by how much away from the horizontal the leg 6 is pivoted. The adjustability of the legs 2, 4 and 6 advantageously provide for accommodating different sizes of footballs.

The bracket 14 includes a portion 38 disposed at a distance from the pivot 24 that acts as a stop for the leg 6 as it is pivoted from the stored to the deployed position. The portion 38 and the corners 30 and 32 are configured such that when the legs 2, 4 and 6 are spread apart to their deployed positions until the stops are engaged, the proper working position of the legs are advantageously repeatedly and quickly attained.

The legs 2 and 4 are advantageously made from solid metal bars for added weight. The leg 6 is advantageously made from tubular material for reduced weight. The free end portion 34 of the leg 6 is flattened to provide sufficient contact surface for the apex or tip 36 of the football 1, as best shown in FIGS. 1 and 3. With a substantial portion of the weight of the kicking tee R concentrated on the legs 2 and 4, the center of gravity of the kicking tee is substantially closer to the pivot structure 8 than to the end portion 34. Therefore, the holding pressure on the football 1 is provided substantially only by a portion of the weight of the leg 6. This advantageously permits quick release of the holding pressure on the football 1 during kicking, thereby preventing interference with the kicker and substantially simulating the release of a player holder.

In operation, the kicking tee R is deployed from its collapsed or stored position, as best shown in FIG. 2, to its operative position, as best shown in FIG. 1. The legs 2 and 4 are spread apart to form an inverted "V" about the pivots 20 and 22 until the corners 30 and 32 engage the side 18. The leg 6 is also deployed to its substantially transverse position relative to the legs 2 and 4 about the pivot 24 until the portion 38 is engaged. The legs 2, 4 and 6 may be adjusted until the correct height 33 for the leg 6 is obtained, limited by the stops provided by the corners 30 and 32 engaging side 18 and portion 38 engaging the leg 6, as best shown in FIGS. 4 and 5. The football 1 is then placed in an upright position with its upper tip 36 engaging the end portion 34 of the leg 6. The kicking tee R is deployed in its place-kicking position with the legs 2 and 4 slightly leaning towards the football 1 such that the center of gravity of the assembly is between the legs 2 and 4 for a stable setup. The football 1 is now ready for kicking by the place kicker.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A kicking tee for holding a football in an upright position for kicking, comprising:

a) first, second and third legs having respective first and second end portions;

b) said first and second legs first end portions being secured together to form an inverted "V" in a substantially vertical plane, said first and second legs second end portions engaging the ground; and c) said third leg first end portion being secured to said first and second legs first end portions such that said third leg is disposed substantially horizontally when said third leg second end portion engages the tip of the football.

2. A football kicking tee as in claim 1, wherein:

a) said first and second legs are heavier than said third leg such a substantial portion of the weight of said tee is carried by said first and second legs.

3. A football kicking tee as in claim 2, wherein:

a) said first and second legs are made of solid metal bars; and b) said third leg is hollow.

4. A football kicking tee as in claim 1, wherein:

a) said third leg is tubular; and b) said third leg free end is flattened.

5. A football kicking tee, comprising:

a) first, second and third legs;

b) a bracket pivotably secured to one end of each of said legs;

c) said first and second legs being adapted to be positioned to form an inverted "V" said first and second legs having free ends for resting on the ground; and d) said third leg being adapted to be positioned substantially horizontally, said third leg having a free end for engaging the apex of a football thereby to position the football in an upright kicking position.

6. A football kicking tee as in claim 5, wherein:

a) said first and second legs are pivotable along substantially a first plane; and b) said third leg is pivotable along a second plane substantially transverse to said first plane.

7. A football kicking tee as in claim 5, wherein:

a) said bracket includes an "U"-shaped portion in cross-section.

8. A football kicking tee as in claim 7, wherein:

a) said bracket includes first and second portions disposed substantially transversely to each other.

9. A football kicking tee as in claim 8, wherein:

a) said first and second legs are pivotably secured to said first portion.

10. A football kicking tee as in claim 5, wherein:

a) said bracket includes a "U"-shaped portion; and b) said third leg is secured to said "U"-shaped portion.

11. A football kicking tee as in claim 5, wherein:

a) said first, second and third legs are substantially equal in length.

12. A football kicking tee as in claim 5, wherein:

a) said bracket includes a deployment stop for each of said first, second and third legs.

13. A device for holding a football in an upright position on the ground for kicking, comprising:

a) pivot assembly having first, second and third stops;

b) a first leg pivotable about said pivot assembly from a first stored position to a first deployed position engaging said first stop;

c) a second leg pivotable about said pivot assembly from a second stored position to a second deployed position engaging said second stop;

d) a third leg pivotable about said pivot assembly from a third stored position to a third deployed position engaging said third stop;

e) said first and second legs in said deployed positions being adapted to stand on the ground; and f) said third leg in said third deployed position being adapted to be positioned substantially horizontally with its free end for engaging the apex of a football, thereby to position the football in an upright kicking position.

14. A device as in claim 13, wherein:

a) said third stop is adapted to deploy said third leg substantially transversely to said first and second legs.

15. A device as in claim 13, wherein:

a) said first and second legs are pivotable along substantially a first plane; and b) said third leg is pivotable along a second plane substantially transverse to said first plane.

16. A device as in claim 13, wherein:

a) said pivot assembly is a bracket including an "L"-shaped portion in cross-section.

17. A device as in claim 16, wherein:

a) said bracket includes first and second portions disposed substantially transversely to each other.

18. A device as in claim 17, wherein:

a) said first and second legs are pivotably secured to said first portion.

19. A device as in claim 16, wherein:

a) said bracket includes a "U"-shaped portion; and b) said third leg is secured to said "U"-shaped portion.

20. A device as in claim 13, wherein:

a) said first, second and third legs are substantially equal in length.

* * * * *